US005863258A

United States Patent [19]

Fulop

[11] Patent Number: 5,863,258

[45] Date of Patent: Jan. 26, 1999

[54] GOLF BALL RETRIEVER WITH COMPRESSION SPRING

[76] Inventor: Charles Fulop, 17664 Candlewood Ter., Boca Raton, Fla. 33487

[21] Appl. No.: 10,533

[22] Filed: Jan. 22, 1998

[51] Int. Cl.[6] ..... A63B 57/00

[52] U.S. Cl. ..... 473/286; 294/19.2

[58] Field of Search ..... 473/286; 294/19.2

[56] References Cited

U.S. PATENT DOCUMENTS

| | | | |
|---|---|---|---|
| 771,886 | 10/1904 | Smith | 294/19.2 |
| 2,810,252 | 9/1957 | Kelley | 56/328 |
| 3,258,286 | 6/1966 | Coward | 294/19.2 |
| 3,316,008 | 4/1967 | Baugh | 294/19 |
| 3,982,781 | 9/1976 | Tucker | 294/19 A |
| 4,063,769 | 12/1977 | Zimmer | 294/19 A |
| 4,596,413 | 6/1986 | La Porte | 294/19.1 |
| 4,964,665 | 10/1990 | Crow | 294/19.2 |
| 5,265,926 | 11/1993 | Dinardo | 294/19.2 |
| 5,437,487 | 8/1995 | Fulop | 294/19.2 |
| 5,651,571 | 7/1997 | Diveto | 294/19.2 |

*Primary Examiner*—Steven Wong
*Assistant Examiner*—Stephen L Blau
*Attorney, Agent, or Firm*—Alvin S. Blum

[57] ABSTRACT

A golf ball retriever includes an elongate telescoping handle to which is attached a frame defining a golf ball entrance plane to be positioned over a golf ball. The dimensions of the plane are large relative to the diameter of the ball so that it is easily positioned under adverse conditions of visibility. A U-shaped hoop connected at both ends to the frame defines a ball-retaining chamber having openings large enough to freely pass mud and debris but too small to pass the ball. An elastic member or spring extends at least partly across the entrance plane, thereby dividing the entrance plane into two parts, neither of which is large enough to permit passage of the ball unless the spring is forced aside. The spring is arranged to be readily forced aside when the frame is pushed onto the ball to admit the ball to the ball-retaining chamber. The spring is stiff enough to prevent spontaneous release of the ball from the chamber. The spring has tubular ends. It may be a helical wire compression spring or a rubbery tube. It is held in place elastically at the entrance plane by two in-line projections attached to opposite sides of the frame that fit into the tubular ends.

11 Claims, 2 Drawing Sheets

GOLF BALL RETRIEVER WITH COMPRESSION SPRING

This invention relates to devices for retrieving golf balls from bodies of water and other areas that are relatively inaccessible.

BACKGROUND OF THE INVENTION

In the game of golf, various obstacles are presented on the course to make successful play more challenging. These may include overgrown vegetation, sand traps, and water hazards. When the ball can be seen, but not reached conveniently, such as in a body of water, the player may be confronted with the loss of the costly ball or employing various implements to retrieve the ball. The U.S. Pat. No. 5,188;409 issued Feb. 12, 1993 to Ferey provides a review of the prior art golf ball retrievers, which are complex and expensive. The retrievers of the prior art generally have a ball receiving aperture that is only slightly larger than the ball diameter. In order to operate these devices successfully, the user must be able to locate the ball and position the retriever over it quite precisely. Because of the refraction of light at the water air interface, this is not easily done. Furthermore, the water surface may be disturbed by wind, also hindering precise positioning of the retriever. Any moving parts are easily disturbed by the sand, mud and other elements to which the device will be exposed in normal operation.

Some retrievers of the prior art employ a spring across the entrance plane to removably reduce the entrance plane dimensions to prevent passage of the ball. Pressure of the ball displaces the spring momentarily enough to pass the ball. These devices employ tension springs whose ends are anchored by passing through holes and bending closed. Every time the spring is displaced, it pulls these ends at the fastening. When the user is pulling the ball free, he may inadvertently pull the spring with it. This may break the spring free at its end or so distort the spring that it no longer closes off the entrance plane. Molding or casting a retriever head with transversely directed holes for the spring ends requires an expensive mold or post molding operations.

SUMMARY OF THE INVENTION

It is, accordingly, an object of the invention to provide a golf ball retriever that is inexpensive and simple in operation. It is another object that the aperture for receiving the ball be much greater than the ball diameter to facilitate retrieval when visibility is difficult. It is another object that the retriever employ a compression spring to economize and simplify construction and avoid the shortcomings of a tension spring.

The retriever of the invention comprises a telescoping elongate handle, one end of which is attached to a frame having an aperture greater than the diameter of the ball arranged for receiving the ball therethrough. A resilient compression spring is attached at two ends to the frame and extends across the plane of the frame aperture, effectively dividing the aperture into at least one portion that has at least one dimension that is less than the diameter of the ball, su that the ball can only pass the aperture by displacing the spring. A U-shaped hoop attached to the frame retains the ball by defining a ball holding space beyond the aperture. To operate the device, one need only position the frame over the ball and push it down. The ball forces the spring aside as it passes through the aperture. The spring then snaps back to its original position after the ball has passed the aperture, thereby securely retaining the ball in the ball retaining space without any special manipulation by the operator. The user removes the ball from the space by simply pulling the ball past the spring.

These and other objects, advantages and features of the invention will become more apparent when the detailed description of the invention is considered in conjunction with the drawings, in which like reference characters designate like elements in the various figures.

DETAILED DESCRIPTION OF PREFERRED EMBODIMENTS

Figure 1:
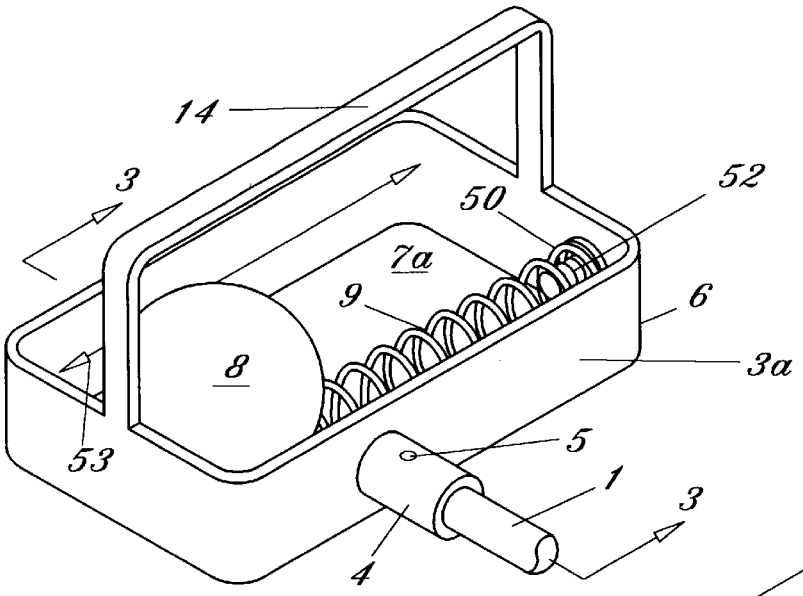
FIG. 1 is a perspective view of the retriever of the invention with a ball engaged and handle broken away.
Figure 2:
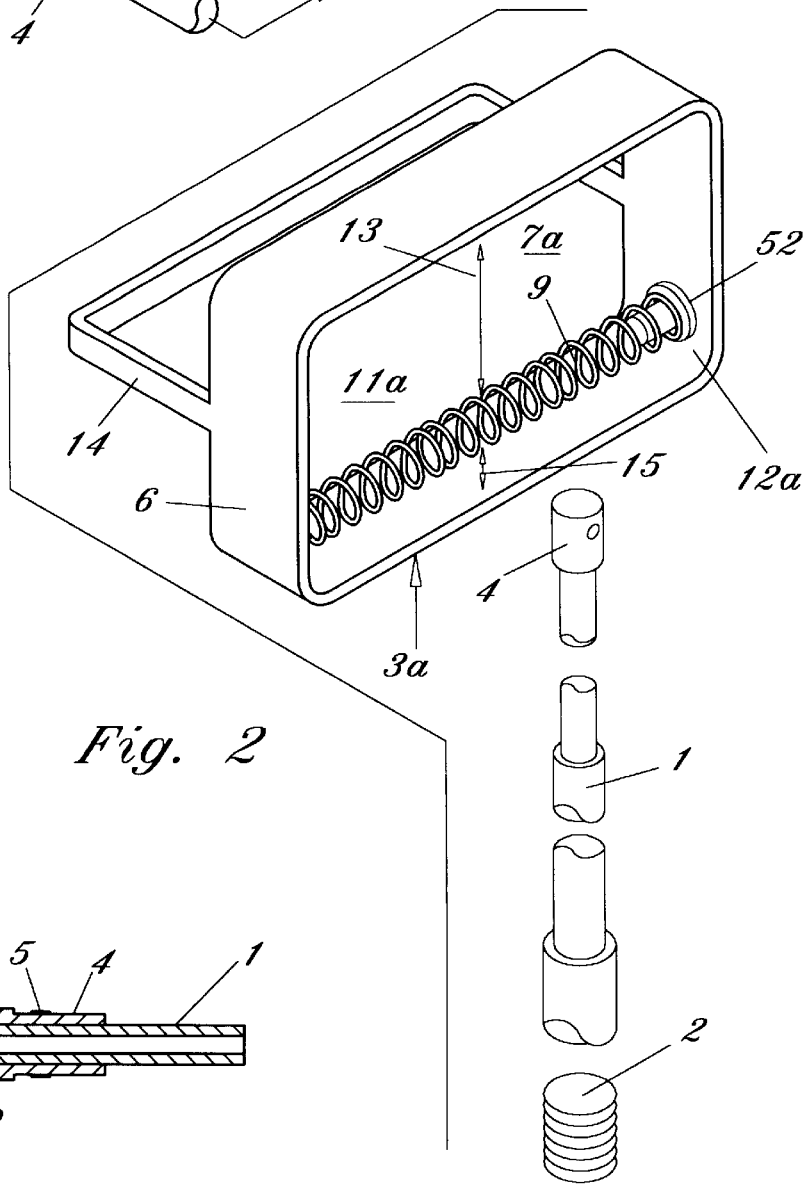
FIG. 2 is a perspective view of the retriever of FIG. 1 inverted.
Figure 3:
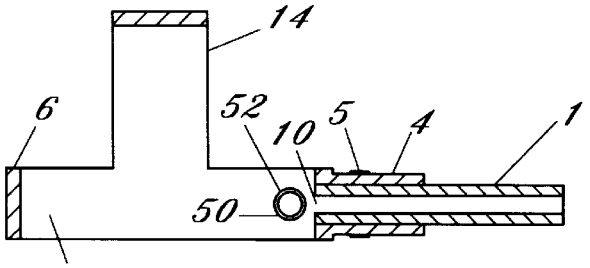
FIG. 3 is a sectional view, taken through line 3—3 of FIG. 1.

Referring now first to FIGS. 1–3, the retriever of the invention comprises a telescoping tubular handle 1 with grip 2 at one end and a ball holding assembly 3*a* at another end. The ball holding assembly 3*a* includes a handle connector 4 which may be fixed to the handle by fastener 5 or adhesive or other means well known in the art. Attached to the handle connector 4 is a frame 6 defining an entrance plane 7*a* through which the ball passes. The dimensions of the entrance plane 7*a* are great enough so that the golf ball 8 passes freely therethrough without requiring precise positioning of the retriever over the ball. A resilient helical wire compression spring 9 is affixed at both tubular ends 50 to the frame 6 by means of two projections 52 that are attached to opposite sides of the frame. They are aligned with one another and dimensioned to fit into the tubular ends 50. This is a simple and inexpensive structure to mold since it has no undercuts. Installation of the spring 9 is also simple and not labor intensive. One tubular end is slipped over one projection. The spring is then compressed until the second end can be slipped over the second projection and the spring then released. The length 53 of the spring is such that when the spring is released, it will extend onto both projections and be held in place by elastic forces, the projections being spaced apart by a distance that is less than the relaxed length of the spring.

The spring 9 divides the entrance plane 7*a* into two areas 11*a* and 12*a* which have small dimensions 13, 15 too small to permit passage of the ball, i.e. less than the diameter of the regulation golf ball of approximately 42 millimeters. The spring has sufficient elasticity to be readily forced aside when the frame is forced down on the ball. It has sufficient stiffness to prevent the weight of the ball from forcing the spring aside when the frame is lifted. A rigid, generally U-shaped hoop 14 is attached to the frame 6. It defines, in combination with frame 6, a ball chamber 15*a* having openings too small to permit passage of the retained ball, yet large enough to pass mud and debris. Consequently, once a ball has moved past the entrance plane by moving aside spring 9, it will be held securely within the chamber 15*a* for secure retrieval. The ball is removed by pulling it out through the entrance plane, thereby forcing spring 9 aside.

Figure 4:
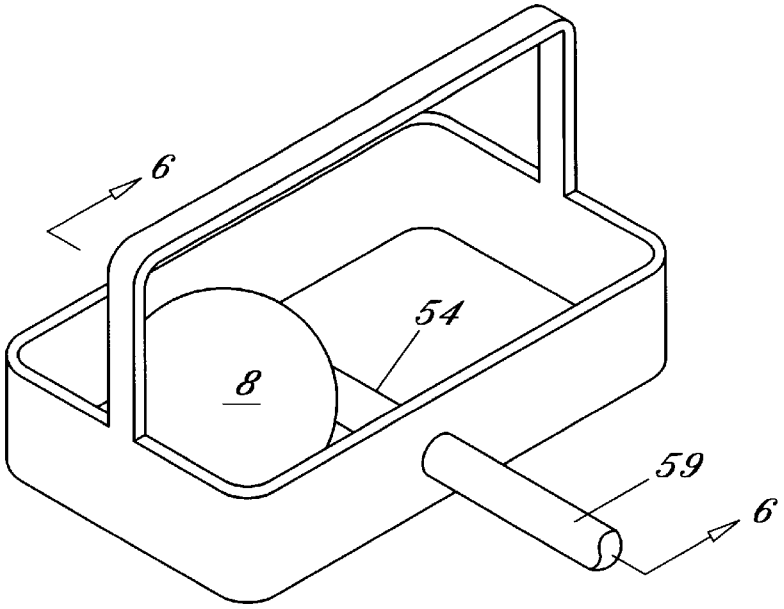
FIG. 4 is a top view of another embodiment of the invention with handle broken away.
Figure 5:
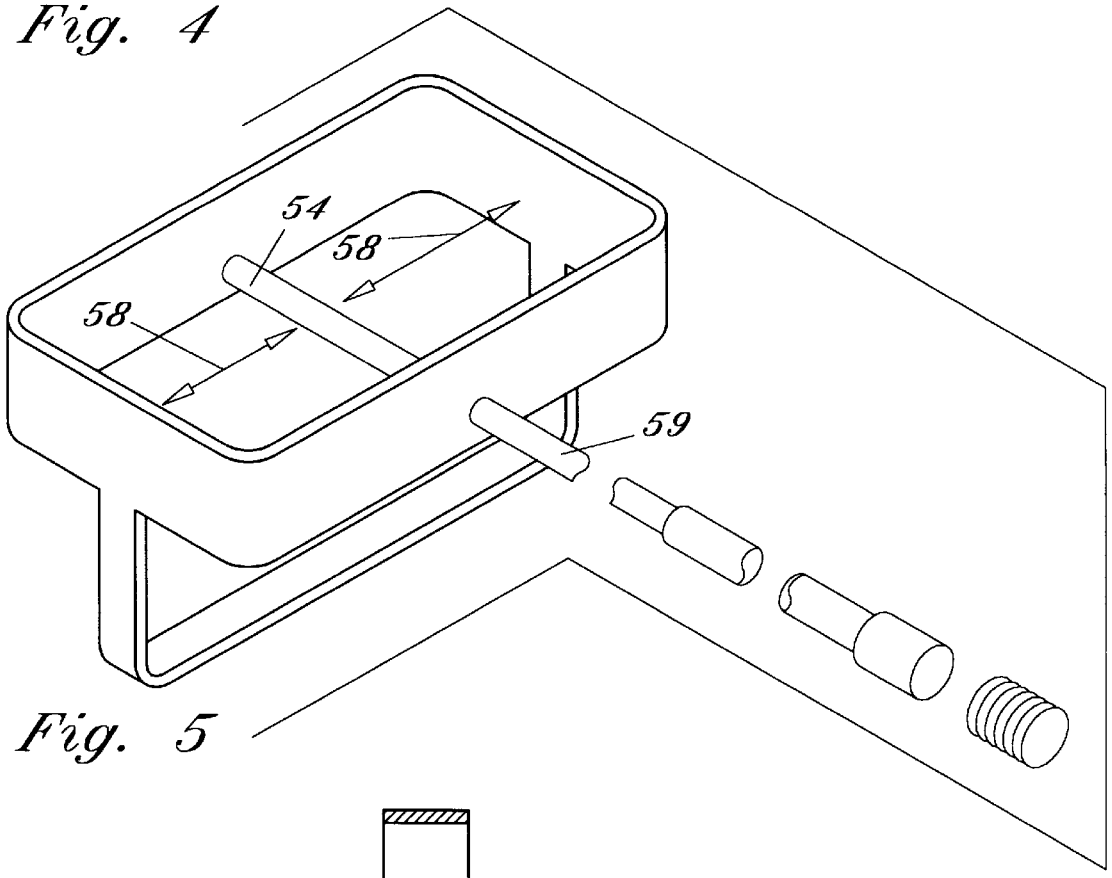
FIG. 5 is a perspective view of the retriever of FIG. 4.
Figure 6:
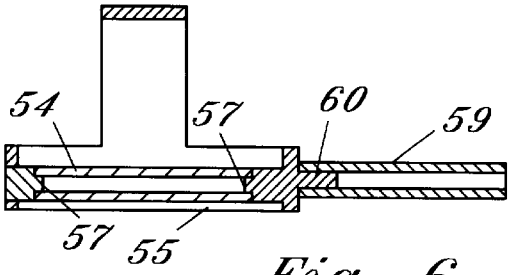
FIG. 6 is a sectional view taken through line 6—6 of FIG. 4.

Referring now to FIGS. 4–6, an alternative embodiment of the invention is shown having a rubbery tube type of compression spring 54 that divides the entrance plane 55 into two substantially equal areas 58 having at least one dimension too small to permit passage of the golf ball until the tube is forced aside by the ball when the frame is forced over the ball. The tube may be made of natural or synthetic rubber or rubber like elastic materials such as the thermoplastic elastomers. It is held in place by the molded-in projections 57 as described above and is installed in the same manner. In this embodiment, the spring tube may be forced to one side or the other so that either area 58 is enlarged sufficiently to pass the ball. The handle 59 is tubular and fits over a cylindrical boss 60 and may be swaged in place for economy of production.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention.

What is claimed is:

1. A retriever for removably engaging a golf ball having a predetermined diameter, the retriever comprising:

a handle affixed at one end to a rigid frame means;

said frame means defining an entrance plane for passage of a golf ball therethrough, said entrance plane having dimensions so much greater than said predetermined ball diameter that said frame means may be positioned over said ball without difficulty for subsequent passage of said ball through said entrance plane;

a single elongate elastic member extending sufficiently across said entrance plane to divide said entrance plane into at least one area, each said at least one area having at least one dimension that is less than the diameter of said ball, said elastic member being elastically biased to a predetermined length, and having two tubular ends;

two projections attached to opposite sides of said frame means and dimensioned to fit into the tubular ends, the projections extending toward and aligned with one another and arranged for holding the elastic member on the frame means, with the projections being spaced apart by a spacing that is less than said predetermined length, so that the projections will lie within the tubular ends and hold the elastic member in place by elastic force; and an elongate hoop member having ends attached to said frame means and extending away from said entrance plane, said hoop member and said frame means defining a ball-retaining chamber having large openings none of which is great enough to permit passage of said ball therethrough, said elastic member being arranged to be readily displaced by said ball when said frame means is forced onto said ball to permit ball passage into said ball-retaining chamber and said elastic member being arranged to resiliently return to a position dividing said entrance plane into areas having dimensions which prevent free passage of said ball from said ball retaining chamber.

2. The retriever according to claim 1, in which said elastic member is a helical wire compression spring.

3. The retriever according to claim 2, in which said hoop member is generally U-shaped.

4. The retriever according to claim 3, in which said handle is affixed to said frame means by a tubular element connected to said frame means.

5. The retriever according to claim 4, in which said handle comprises telescoping tubes.

6. The retriever according to claim 5, in which said elastic member divides said entrance plane into two substantially equal parts when said elastic member is not stressed.

7. The retriever according to claim 5, in which said elastic member divides said entrance plane into two unequal parts when said elastic member is not stressed.

8. The retriever according to claim 1, in which said elastic member is an elastic tube.

9. The retriever according to claim 8, in which said handle comprises telescoping tubes.

10. A retriever for removably engaging a golf ball having a predetermined diameter, the retriever comprising:

a handle affixed at one end to a rigid frame means;

said frame means defining an entrance plane for passage of a golf ball therethrough, said entrance plane having dimensions so much greater than said predetermined ball diameter that said frame means may be positioned over said ball without difficulty for subsequent passage of said ball through said entrance plane;

a single elongate elastic occluding means having two tubular ends, and supported at said entrance plane to partially occlude said entrance plane, the partially occluded entrance plane having at least one dimension that is less than the diameter of said ball;

a hoop member having ends attached to said frame means and extending away from said entrance plane, said hoop member and said partially occluded entrance plane cooperating to define a ball retaining chamber having dimensions for free movement of said ball therein and having large openings none of which are great enough to permit passage of said ball therethrough;

two projections attached to opposite sides of said frame means and dimensioned to fit into the tubular ends, the projections extending toward and aligned with one another and arranged for holding the elastic member on the frame means, with the projections being spaced apart by a spacing that is less than said predetermined length, so that the projections will lie within the tubular ends and hold the elastic member in place by elastic force; said elastic member being arranged to be readily displaced by said ball when said frame means is forced onto said ball to permit ball passage into said ball-retaining chamber and said elastic member being arranged to resiliently return to a position dividing said entrance plane into areas having dimensions which prevent free passage of said ball from said ball retaining chamber; and said elastic member being a helical wire compression spring.

11. A retriever for removably engaging a golf ball having a predetermined diameter, the retriever comprising:

a handle affixed at one end to a rigid frame means;

said frame means defining an entrance plane for passage of a golf ball therethrough, said entrance plane having dimensions so much greater than said predetermined ball diameter that said frame means may be positioned over said ball without difficulty for subsequent passage of said ball through said entrance plane;

a single elongate elastic occluding means having two tubular ends, and supported at said entrance plane to partially occlude said entrance plane, the partially occluded entrance plane having at least one dimension that is less than the diameter of said ball;

a hoop member having ends attached to said frame means and extending away from said entrance plane, said hoop member and said partially occluded entrance plane cooperating to define a ball retaining chamber having dimensions for free movement of said ball therein and having large openings none of which are great enough to permit passage of said ball therethrough;

two projections attached to opposite sides of said frame means and dimensioned to fit into the tubular ends, the projections extending toward and aligned with one another and arranged for holding the elastic member on the frame means, with the projections being spaced apart by a spacing that is less than said predetermined length, so that the projections will lie within the tubular ends and hold the elastic member in place by elastic force; said elastic member being arranged to be readily displaced by said ball when said frame means is forced onto said ball to permit ball passage into said ball-retaining chamber and said elastic member being arranged to resiliently return to a position dividing said entrance plane into areas having dimensions which prevent free passage of said ball from said ball retaining chamber; and said elastic member being an elastic tube.

* * * * *